US009526334B2

(12) United States Patent
Liang et al.

(10) Patent No.: US 9,526,334 B2
(45) Date of Patent: Dec. 27, 2016

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 49 days.

(21) Appl. No.: 14/620,336

(22) Filed: Feb. 12, 2015

(65) Prior Publication Data

US 2016/0235198 A1 Aug. 18, 2016

(51) Int. Cl.
*A47B 88/14* (2006.01)

(52) U.S. Cl.
CPC ..... *A47B 88/14* (2013.01); *A47B 2210/007* (2013.01); *A47B 2210/0067* (2013.01); *A47B 2210/0075* (2013.01)

(58) Field of Classification Search
CPC ..... A47B 88/00; A47B 88/10; A47B 88/14; A47B 2210/0097; A47B 88/08; A47B 88/12; A47B 2210/0064; A47B 2210/0067; A47B 2210/007; A47B 2210/0072; A47B 2210/0075; A47B 2210/0081
See application file for complete search history.

(56) References Cited

U.S. PATENT DOCUMENTS 3,857,618 A * 12/1974 Hagen ..... A47B 88/10 312/331
4,351,575 A * 9/1982 Rock ..... A47B 88/10 312/334.12
4,470,642 A * 9/1984 Gasperin ..... A47B 88/10 312/331
6,499,818 B2 * 12/2002 Brustle ..... A47B 88/047 312/319.1
6,848,759 B2 * 2/2005 Doornbos ..... A47B 88/047 16/64
7,309,115 B2 12/2007 Blum et al.
7,815,267 B1 * 10/2010 Frousiakis ..... A47B 88/047 312/319.1
7,905,561 B2 3/2011 Ritter
8,167,388 B2 * 5/2012 Hammerle ..... A47B 88/10 312/334.13

(Continued)

*Primary Examiner* — Alan B Waits
(74) *Attorney, Agent, or Firm* — Rosenberg, Klein & Lee

(57) ABSTRACT

A slide rail assembly includes first and second rails, a running carriage, a correction mechanism, and an actuator. The running carriage is slidably mounted on the first rail, carries the second rail, and, when the second rail is longitudinally displaced relative to the first rail, is differentially moved relative to the second rail. The correction mechanism is mounted on the first rail and includes an action member and a pushing member movably connected to the action member. The actuator is connected to the second rail. Should a differential movement error of the running carriage occur, the actuator drives the action member while the second rail is being extended, thereby displacing the pushing member, and hence the running carriage, so as to correct the error.

11 Claims, 12 Drawing Sheets

(56) References Cited

U.S. PATENT DOCUMENTS

| | | | | |
|---|---|---|---|---|
| 8,714,670 | B2 * | 5/2014 | Kuo | A47B 88/16<br>312/223.1 |
| 8,960,820 | B2 * | 2/2015 | Chen | A47B 88/04<br>312/331 |
| 9,044,088 | B2 * | 6/2015 | Greussing | A47B 88/10 |
| 9,277,816 | B2 * | 3/2016 | Chen | A47B 88/04 |
| 2001/0008037 | A1 * | 7/2001 | Brustle | A47B 88/047<br>16/71 |
| 2003/0067257 | A1 * | 4/2003 | Gasser | A47B 88/047<br>312/331 |
| 2004/0107536 | A1 * | 6/2004 | Hollenstein | A47B 88/047<br>16/94 R |
| 2009/0033187 | A1 * | 2/2009 | Chung | A47B 88/047<br>312/319.1 |
| 2011/0154817 | A1 * | 6/2011 | Zimmer | F03G 7/065<br>60/528 |
| 2013/0002115 | A1 * | 1/2013 | Friesenecker | A47B 88/10<br>312/334.8 |
| 2013/0249367 | A1 * | 9/2013 | Chen | A47B 88/14<br>312/334.8 |
| 2013/0270987 | A1 * | 10/2013 | Kelly | A47B 88/12<br>312/331 |
| 2013/0270989 | A1 * | 10/2013 | Park | A47B 88/04<br>312/404 |

* cited by examiner

SLIDE RAIL ASSEMBLY

FIELD OF THE INVENTION

The present invention relates to a slide rail assembly. More particularly, the present invention relates to a slide rail assembly whose first rail is connected with a correction mechanism for correcting errors in differential movement of a running carriage relative to a second rail.

BACKGROUND OF THE INVENTION

Generally, slide rail assemblies are used with drawers and the like. Such a slide rail assembly typically includes a first rail, a second rail longitudinally displaceable relative to the first rail, and a running carriage mounted between the first rail and the second rail. The running carriage serves to carry the second rail and facilitate displacement of the second rail relative to the first rail. When the second rail is displaced relative to the first rail, the running carriage is moved relative to the second rail in a differential manner; that is to say, the distance by which the running carriage is displaced is a specific proportion of the distance by which the second rail is displaced. However, precise differential movement is not always guaranteed. Errors may occur in differential movement of the running carriage relative to the second rail.

The specification and drawings of U.S. Pat. No. 7,309,115 B2, for example, disclose a pull-out guide assembly for drawers, wherein the pull-out guide assembly includes a support rail (1), a pull-out rail (2), and a running carriage (3) movably mounted between the support rail (1) and the pull-out rail (2). The running carriage (3) can be differentially moved relative to the pull-out rail (2) between a front end position and a rear end position. Also, the running carriage (3) is mounted with a stop device for correcting errors in differential movement of the running carriage (3) relative to the rails. The disclosure of the afore-cited patent is incorporated herein by reference.

SUMMARY OF THE INVENTION

The present invention relates to a slide rail assembly in which a correction mechanism is connected to a first rail and can correct errors in differential movement of a running carriage relative to a second rail.

According to one aspect of the present invention, a slide rail assembly includes a first rail, a second rail, a running carriage, a correction mechanism, and an actuator. The second rail can be longitudinally displaced relative to the first rail between a retracted position and an extended position. The running carriage is slidably mounted to the first rail, carries the second rail, and can be moved together with the second rail in a differential manner with respect to the second rail. The correction mechanism is mounted to the first rail and includes an action member and a pushing member movably connected to the action member. The actuator is connected to the second rail. Should an error occur in differential movement of the running carriage, the actuator drives the action member while the second rail is displaced from the retracted position toward the extended position. As a result, the action member displaces the pushing member relative to the first rail and thereby displaces the running carriage to correct the error.

According to another aspect of the present invention, a slide rail assembly is provided for use with a cabinet having a drawer. The slide rail assembly includes a first rail, a second rail, a third rail, a running carriage, a correction mechanism, and an actuator. The first rail is mounted to the cabinet. The second rail is movably mounted between the first rail and the third rail and can be longitudinally displaced relative to the first rail between a retracted position and an extended position. The third rail carries the drawer. The running carriage is slidably mounted to the first rail, carries the second rail, and can be moved together with the second rail in a differential manner with respect to the second rail. The correction mechanism is mounted to the first rail and includes an action member and a pushing member movably connected to the action member. The actuator is connected to the second rail. Should an error occur in differential movement of the running carriage, the actuator drives the action member while the second rail is displaced from the retracted position toward the extended position. As a result, the action member displaces the pushing member relative to the first rail and thereby displaces the running carriage to correct the error.

According to another aspect of the present invention, a slide rail assembly includes a first rail, a second rail, a running carriage, and a correction mechanism. The second rail can be longitudinally displaced relative to the first rail. The running carriage is slidably mounted to the first rail and is configured to carry the second rail. The correction mechanism is mounted to the first rail and includes an action member and a pushing member movably connected to the action member. The action member is able to be driven by the second rail to displace the pushing member for displacing the running carriage to a position.

In some embodiment of any of the above aspects, the slide rail assembly further includes a pivotal connecting element for pivotally connecting the action member of the correction mechanism to the first rail, and the action member further includes a contact portion. While the second rail is displaced relative to the first rail between the retracted position and the extended position, the actuator pushes the contact portion and thereby rotates the action member.

In some embodiments of any of the above aspects, the action member of the correction mechanism further includes teeth, and the pushing member further includes a toothed rack meshing with the teeth. When the action member is driven by the actuator, the teeth drive the toothed rack and thereby displace the pushing member relative to the first rail.

In some embodiments of any of the above aspects, the pushing member further includes a guide groove, and the pivotal connecting element extends through the guide groove.

In some embodiments of any of the above aspects, the correction mechanism further includes an elastic member, and the pushing member is configured to automatically return from a displaced position to a predetermined position in response to an elastic force provided by the elastic member.

In some embodiments of any of the above aspects, the correction mechanism further includes a base connected to the first rail, and the pushing member is movably connected to the base.

In some embodiments of any of the above aspects, the base further includes a dividing portion, the pushing member further includes a receiving room for receiving the elastic member, and the dividing portion of the base abuts against a portion of the elastic member. Alternatively, the dividing portion is provided on the first rail, and the dividing portion of the first rail abuts against a portion of the elastic member.

In some embodiments of any of the above aspects, the running carriage further includes at least one roller for carrying the second rail.

One of the advantageous features of employing the present invention is that the correction mechanism on the first rail can correct differential movement errors of the running carriage with respect to the second rail, if any.

BRIEF DESCRIPTION OF THE DRAWINGS

The structure as well as a preferred mode of use and the advantages of the present invention will be best understood by referring to the following detailed description of some illustrative embodiments in conjunction with the accompanying drawings, in which.

DETAILED DESCRIPTION OF THE INVENTION

Figure 1:
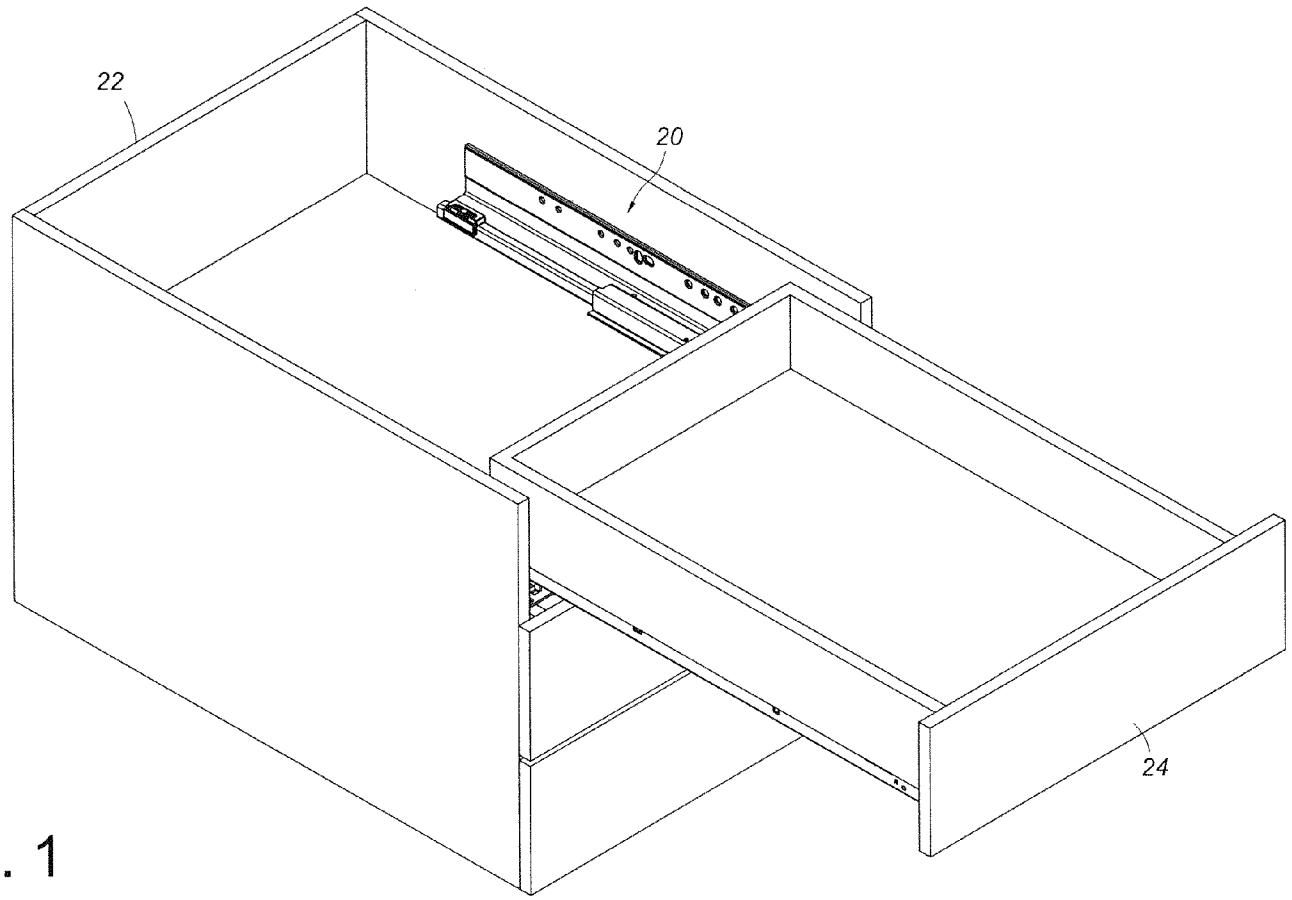
FIG. 1 is a perspective view showing how the slide rail assembly in an embodiment of the present invention is applied to a drawer of a cabinet.

Referring to FIG. 1, the slide rail assembly 20 in an embodiment of the present invention is applied to a cabinet 22 which includes at least one drawer 24. The at least one drawer 24 can be easily pulled out of and pushed back into the cabinet 22 via the slide rail assembly 20.

Figure 2:
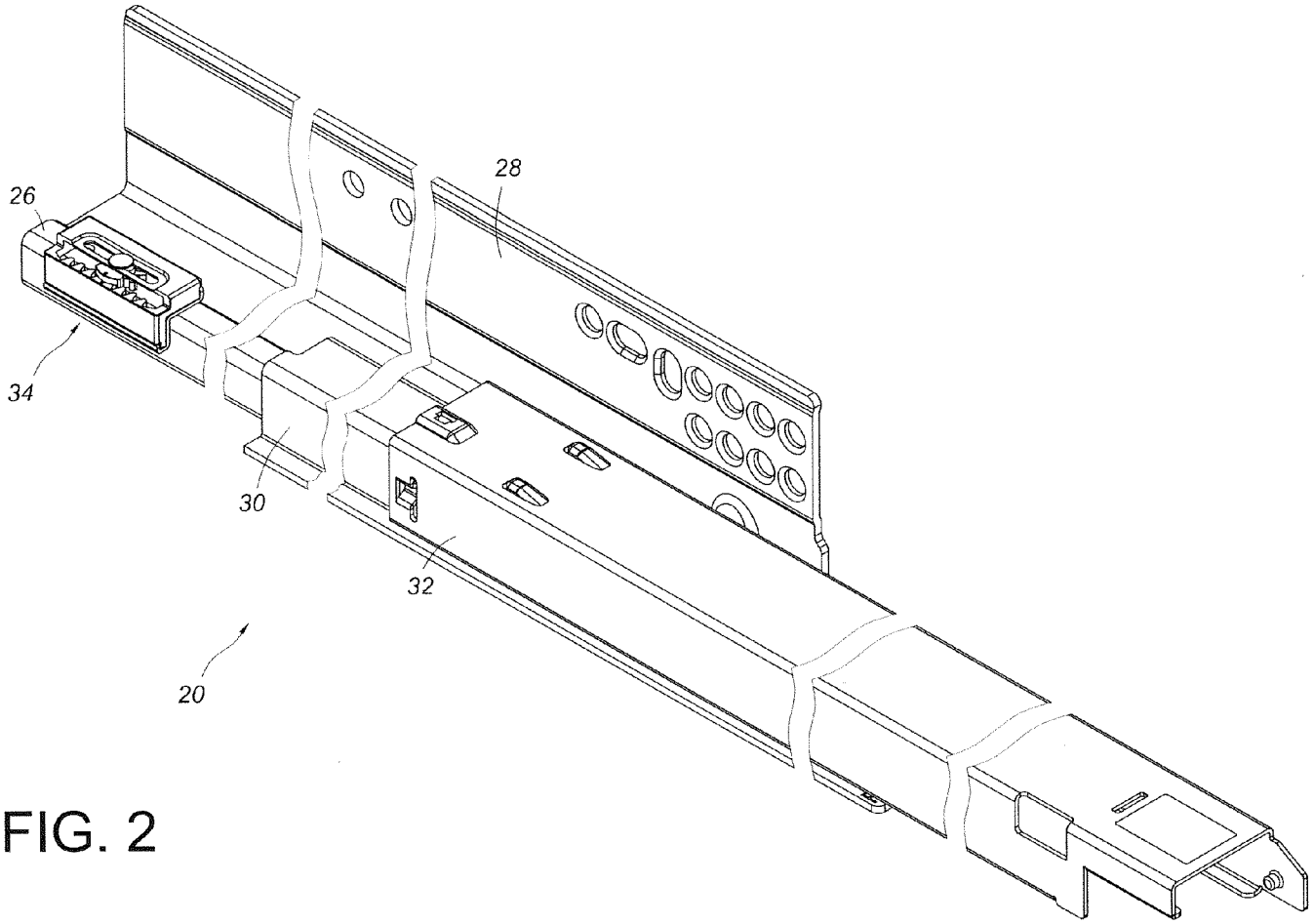
FIG. 2 is a perspective view of the slide rail assembly in an embodiment of the present invention, wherein the slide rail assembly is in an extended state.

FIG. 2 shows the slide rail assembly 20 in an extended state. The slide rail assembly 20 includes a first rail 26 and a second rail 30. In this embodiment, the slide rail assembly 20 further includes a third rail 32. The first rail 26 is mounted to the cabinet 22 via a mounting portion 28. In addition, a correction mechanism 34 is mounted to the first rail 26. The correction mechanism 34 in this embodiment is connected to the first rail 26 at a position adjacent to an end portion of the first rail 26 by way of example and not as a limitation. As the correction mechanism 34 is connected to the first rail 26, the correction mechanism 34 can be viewed as a part of the first rail 26. The second rail 30 and the third rail 32 can be longitudinally displaced relative to the first rail 26. The second rail 30 is movably mounted between the first rail 26 and the third rail 32. The third rail 32 is configured for carrying the drawer 24.

Figure 3:
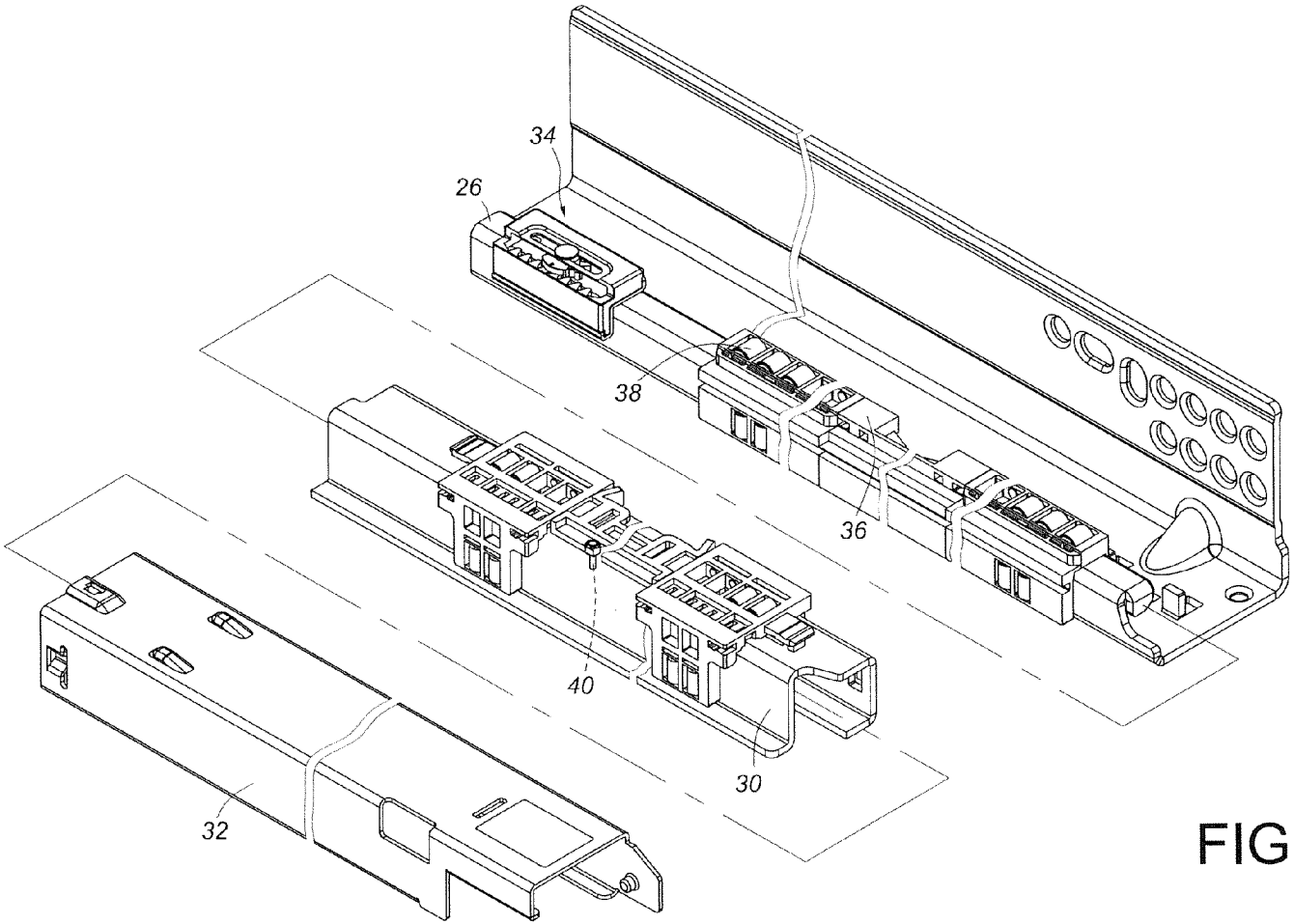
FIG. 3 is an exploded view of the slide rail assembly in an embodiment of the present invention.
Figure 4:
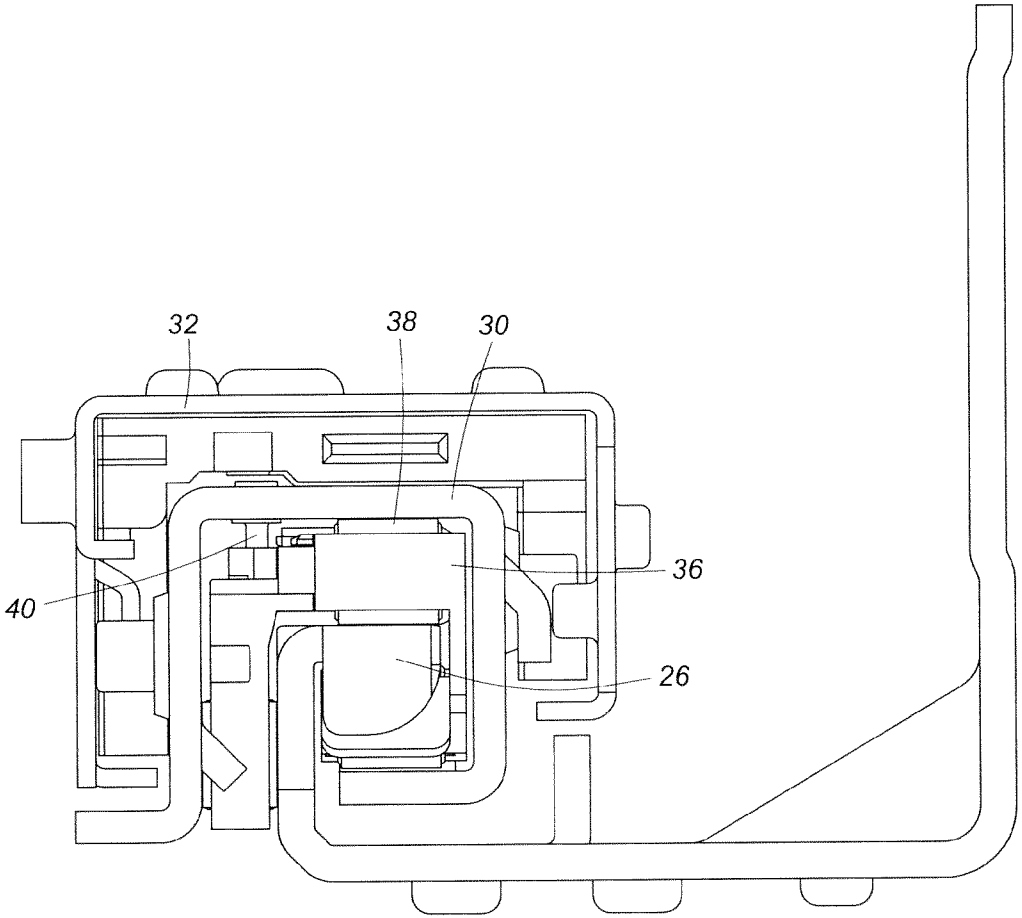
FIG. 4 is a front view of the slide rail assembly in an embodiment of the present invention.
Figure 5:
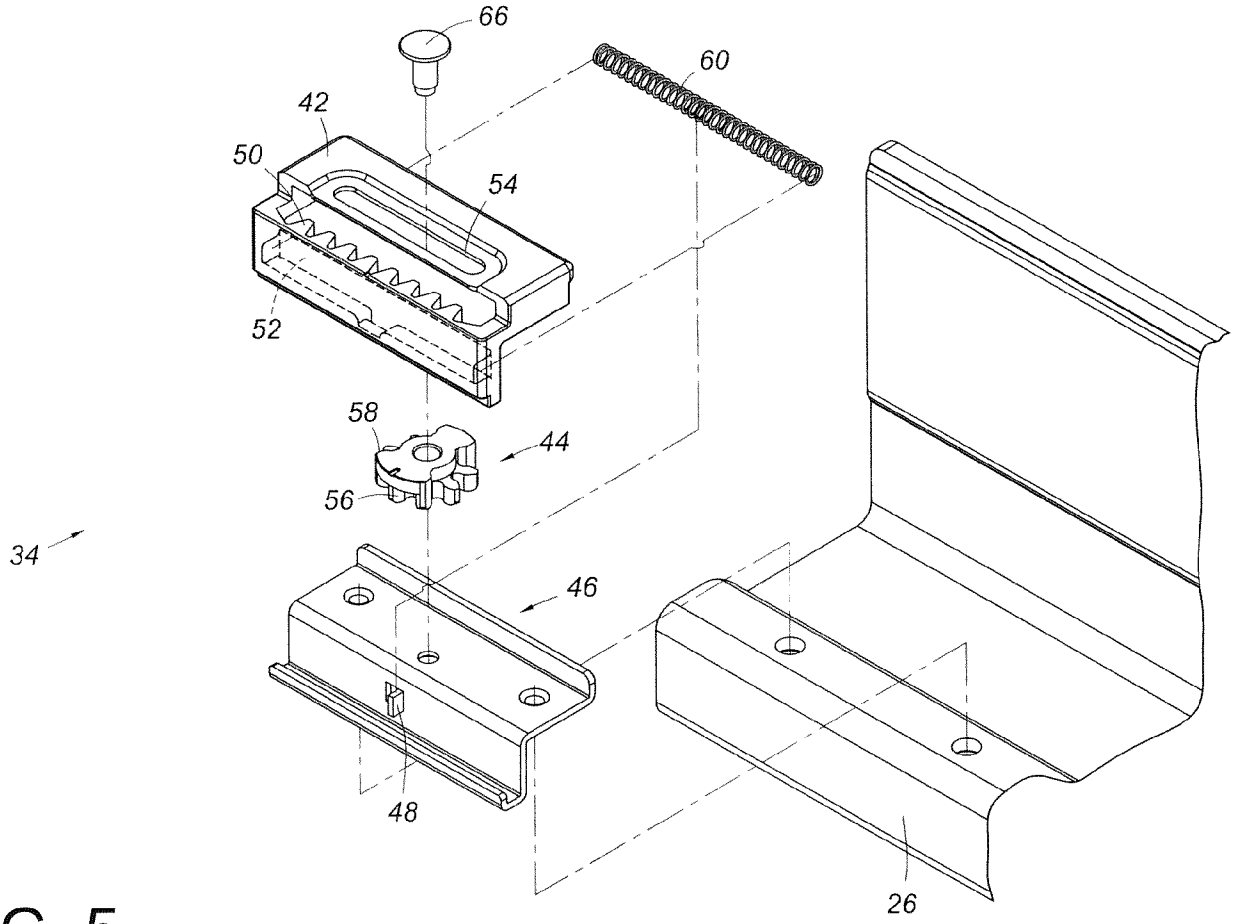
FIG. 5 is an exploded view of the correction mechanism and the first rail in an embodiment of the present invention.
Figure 6A:
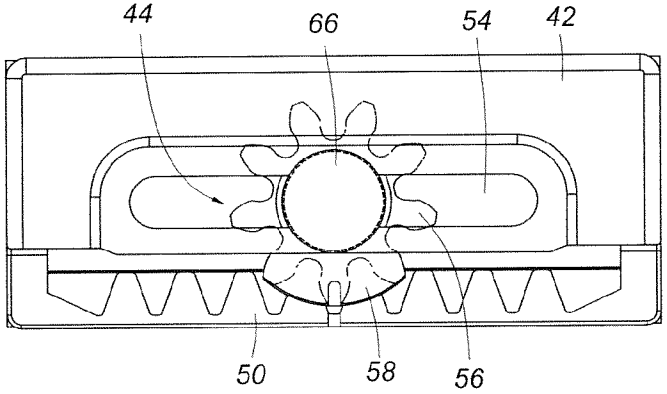
FIG. 6A is a plan view of the correction mechanism in an embodiment of the present invention, showing in particular how the teeth of the action member mesh with the toothed rack of the pushing member.
Figure 6B:
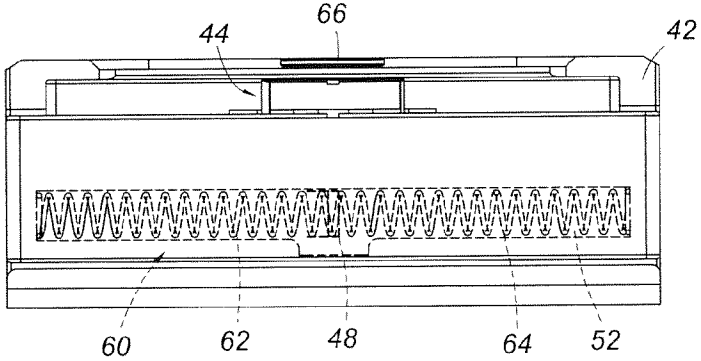
FIG. 6B is another plan view of the correction mechanism in FIG. 6A, showing in particular how the dividing portion abuts against a portion of the elastic member and divides the elastic member into a first elastic section and a second elastic section.
Figure 6C:
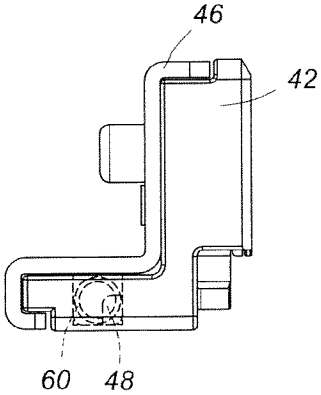
FIG. 6C is still another plan view of the correction mechanism in FIG. 6A, showing from a different angle how the dividing portion abuts against a portion of the elastic member.

FIG. 3 and FIG. 4 show the first rail 26, the second rail 30, and the third rail 32 in an exploded view and an assembled view respectively. A running carriage 36 is slidably mounted to the first rail 26 and is configured for carrying the second rail 30. The running carriage 36 further includes at least one roller 38 (or ball) for carrying the second rail 30 and assisting the second rail 30 in displacing relative to the first rail 26. In addition, an actuator 40 is fixedly connected to the second rail 30. The actuator 40 can be, but is not limited to, a projection or a bar-like member. In some embodiments, the actuator 40 can be viewed as a portion of the second rail 30. When an error occurs in differential movement of the running carriage 36 relative to the second rail 30, the correction mechanism 34 can be driven by the actuator 40 to correct the error of the running carriage 36, as explained in more detail below.

As shown in FIG. 5 and FIG. 6A to FIG. 6C, the correction mechanism 34 includes a pushing member 42 and an action member 44, both mounted to the first rail 26. In this embodiment, the pushing member 42 and the action member 44 are mounted to the first rail 26 along with a base 46, wherein the pushing member 42 is movably connected to the base 46. More specifically, the base 46 is mounted to the first rail 26 via at least one mounting element (not shown) and, according to a preferred embodiment, includes a dividing portion 48; the pushing member 42 is movably connected to the action member 44 and includes a toothed rack 50, a receiving room 52, and a guide groove 54; the action member 44 further includes a plurality of teeth 56 and a contact portion 58, wherein the teeth 56 correspondingly mesh with the toothed rack 50 of the pushing member 42; an elastic member 60 is received in the receiving room 52 of the pushing member 42, with the dividing portion 48 of the base 46 stuck somewhere between the two ends of the elastic member 60 (for example but without limitation, the dividing portion 48 substantially abutting against a middle portion of the elastic member 60) such that the elastic member 60 is divided by the dividing portion 48 into a first elastic section 62 and a second elastic section 64; and a pivotal connecting element 66 passes through the guide groove 54 of the pushing member 42 to pivotally connect the action member 44 to the base 46.

Figure 7A:
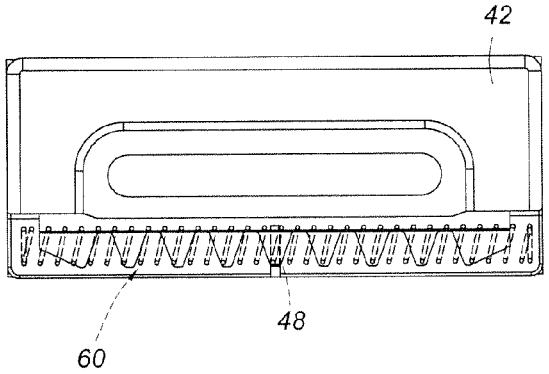
FIG. 7A is a plan view of the pushing member and the base of the correction mechanism in an embodiment of the present invention, wherein the pushing member has yet to be subjected to an applied force.
Figure 7B:
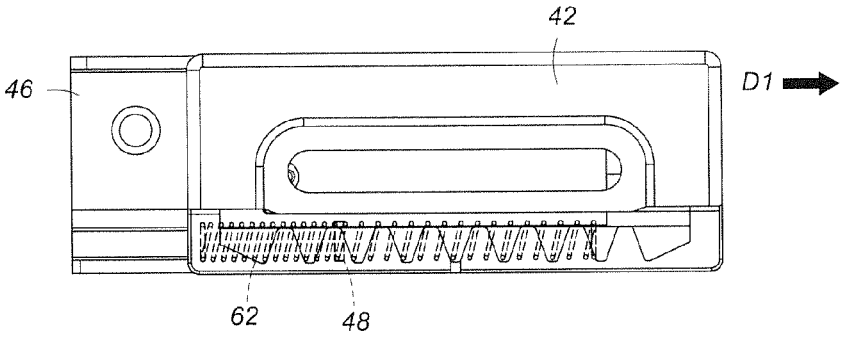
FIG. 7B is another plan view of the pushing member and the base in FIG. 7A, showing in particular how the pushing member is displaced in a first direction by an applied force such that the first elastic section of the elastic member is compressed between the pushing member and the dividing portion and stores an elastic force.

Referring to FIG. 7A and FIG. 7B, a force is applied to the pushing member 42 to displace the pushing member 42 from a predetermined position (as shown in FIG. 7A) in a first direction D1. In the course in which the pushing member 42 is displaced relative to the base 46 in the first direction D1, the first elastic section 62 of the elastic member 60 is compressed between the pushing member 42 and the dividing portion 48 and stores an elastic force. When the force applied is removed, the first elastic section 62 of the elastic member 60 releases the elastic force, and in response to the elastic force released, the pushing member 42 automatically returns from the displaced position shown in FIG. 7B to the predetermined position shown in FIG. 7A.

Figure 7C:
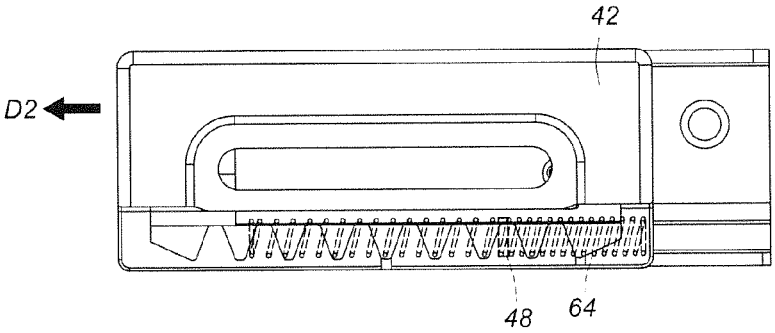
FIG. 7C is yet another plan view of the pushing member and the base in FIG. 7A, showing in particular how the pushing member is displaced in a second direction by an applied force such that the second elastic section of the elastic member is compressed between the pushing member and the dividing portion and stores an elastic force.
Figure 8A:
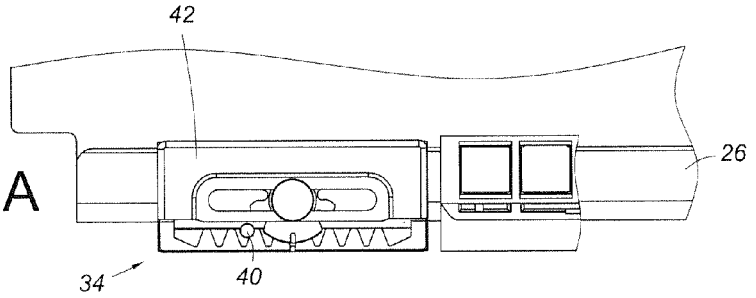
FIG. 8A is a schematic drawing in which the pushing member in an embodiment of the present invention is at a predetermined position.
Figure 8B:
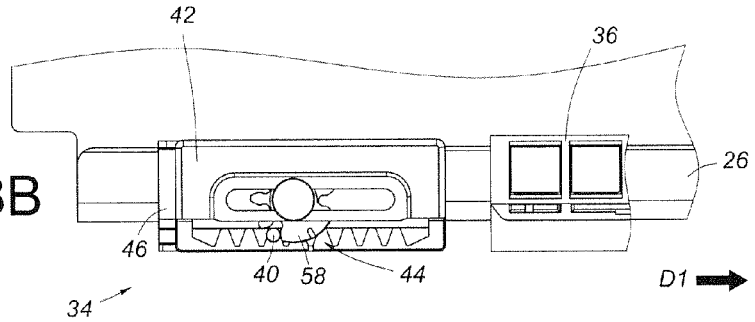
FIG. 8B schematically shows how the running carriage in the embodiment of FIG. 8A is differentially moved in a normal manner as the second rail is displaced relative to the first rail from a retracted position toward an extended position, with the actuator driving the action member, and hence the pushing member, such that the pushing member is displaced relative to the base from the predetermined position.
Figure 8C:
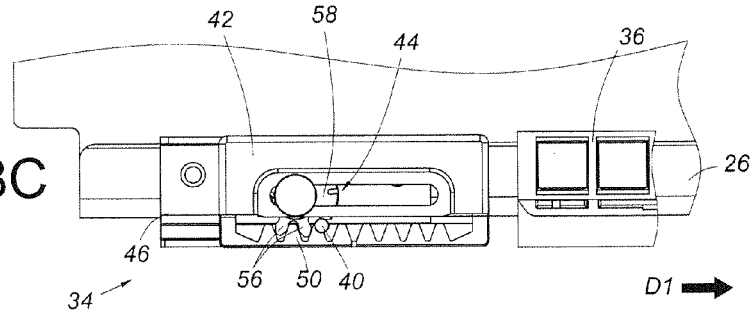
FIG. 8C schematically shows how the running carriage in the embodiment of FIG. 8A is further differentially moved in a normal manner as the second rail is displaced relative to the first rail from the retracted position toward the extended position, with the actuator further driving the action member, and hence the pushing member, such that the pushing member is further displaced relative to the base from the predetermined position.
Figure 8D:
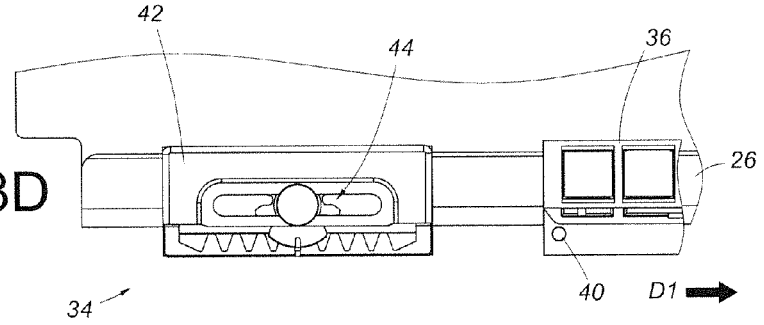
FIG. 8D schematically shows how the running carriage in the embodiment of FIG. 8A is further differentially moved in a normal manner as the second rail is displaced relative to the first rail from the retracted position toward the extended position, and how the pushing member automatically returns to the predetermined position as a result of the actuator moving past the action member.
Figure 9A:
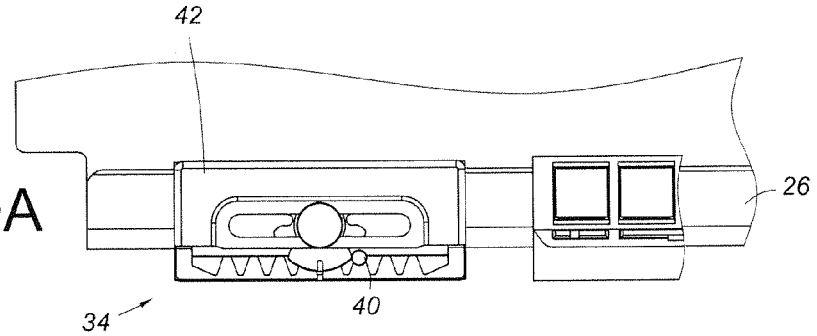
FIG. 9A is a schematic drawing in which the pushing member in an embodiment of the present invention is at a predetermined position.
Figure 9B:
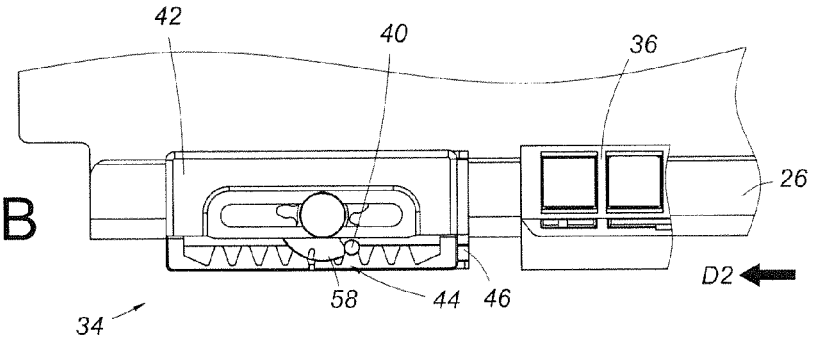
FIG. 9B schematically shows how the running carriage in the embodiment of FIG. 9A is differentially moved in a normal manner as the second rail is displaced relative to the first rail from an extended position toward a retracted position, with the actuator driving the action member, and hence the pushing member, such that the pushing member is displaced relative to the base from the predetermined position.
Figure 9C:
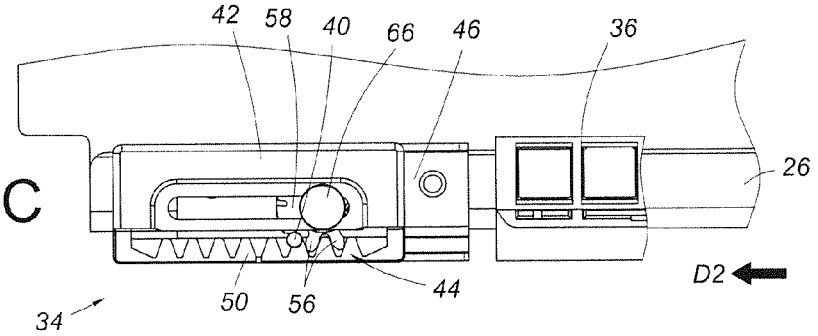
FIG. 9C schematically shows how the running carriage in the embodiment of FIG. 9A is further differentially moved in a normal manner as the second rail is displaced relative to the first rail from the extended position toward the retracted position, with the actuator further driving the action member, and hence the pushing member, such that the pushing member is further displaced relative to the base from the predetermined position.
Figure 9D:
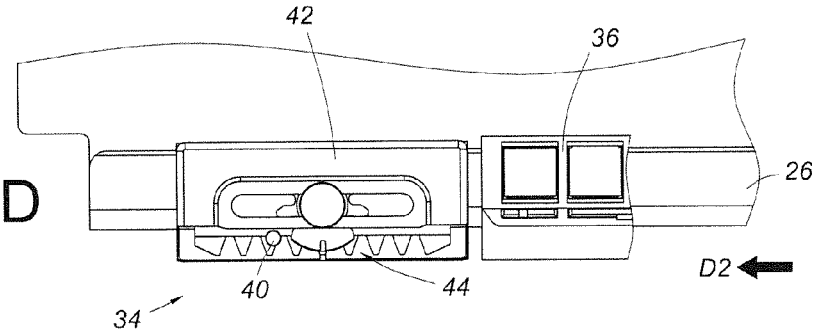
FIG. 9D schematically shows how the running carriage in the embodiment of FIG. 9A is further differentially moved in a normal manner as the second rail is displaced relative to the first rail from the extended position toward the retracted position, and how the pushing member automatically returns to the predetermined position as a result of the actuator moving past the action member.
Figure 10A:
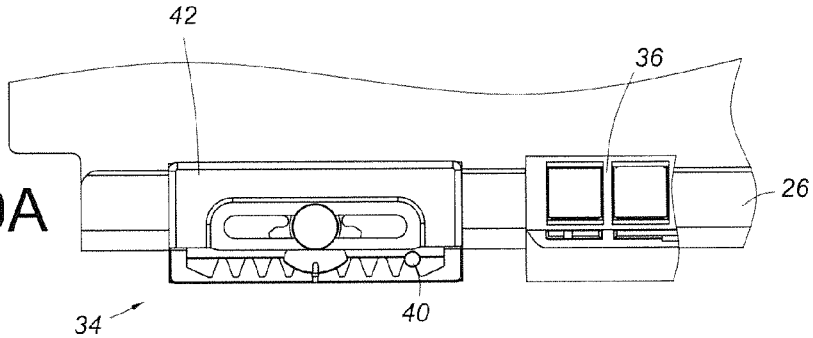
FIG. 10A is a schematic drawing in which the pushing member in an embodiment of the present invention is at a predetermined position.
Figure 10B:
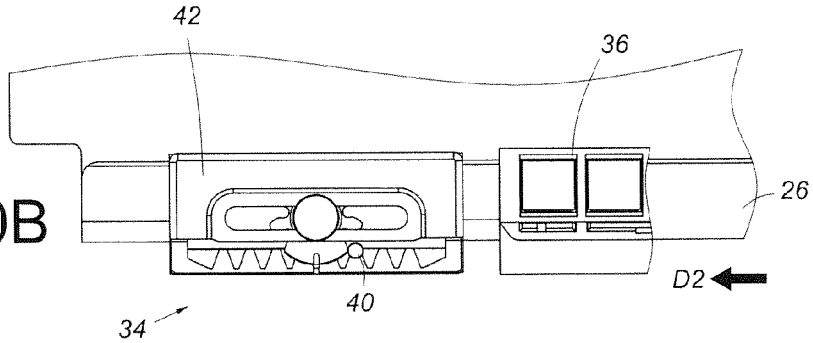
FIG. 10B schematically shows how the second rail in the embodiment of FIG. 10A is displaced relative to the first rail from an extended position toward a retracted position while the pushing member remains at the predetermined position.
Figure 10C:
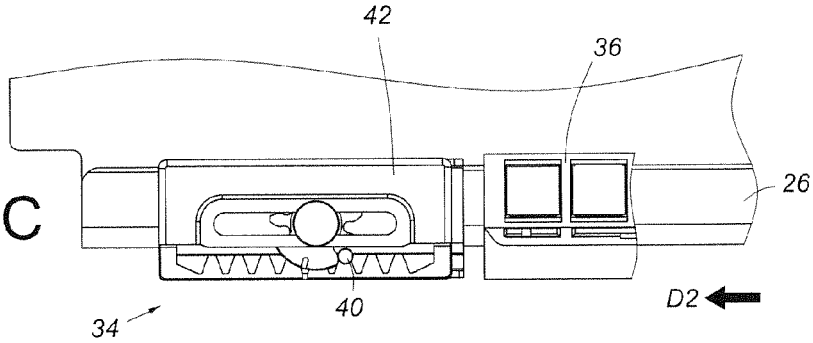
FIG. 10C schematically shows how the running carriage in the embodiment of FIG. 10A is differentially moved in an abnormal manner as the second rail is displaced relative to the first rail from the extended position toward the retracted position, with the actuator driving the action member, and hence the pushing member, such that the pushing member is displaced relative to the base from the predetermined position.
Figure 10D:
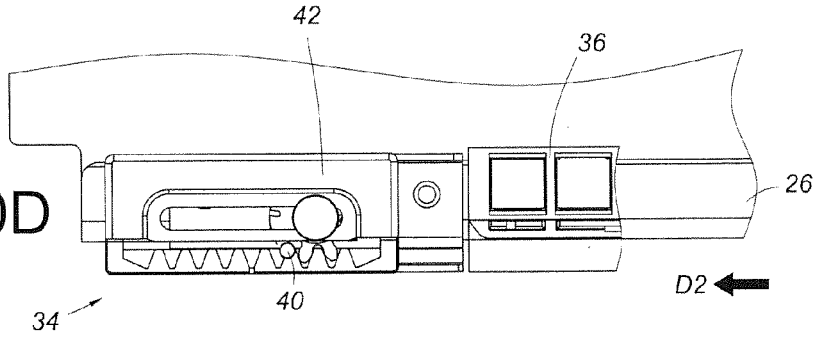
FIG. 10D schematically shows how the running carriage in the embodiment of FIG. 10A is further differentially moved in an abnormal manner as the second rail is displaced relative to the first rail from the extended position toward the retracted position, with the actuator further driving the action member, and hence the pushing member, such that the pushing member is further displaced relative to the base from the predetermined position.
Figure 11A:
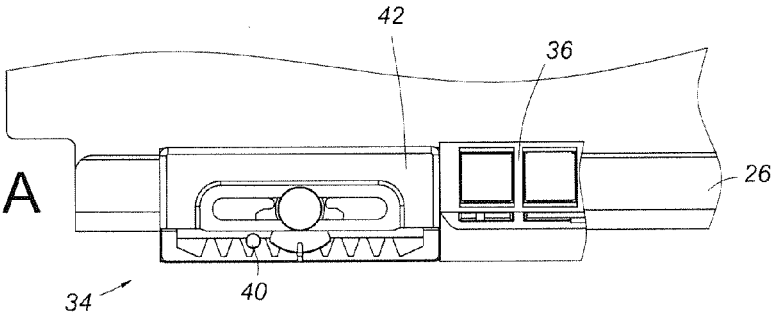
FIG. 11A is a schematic drawing in which the pushing member in an embodiment of the present invention is at a predetermined position while the running carriage is at an erroneous position due to abnormal differential movement.
Figure 11B:
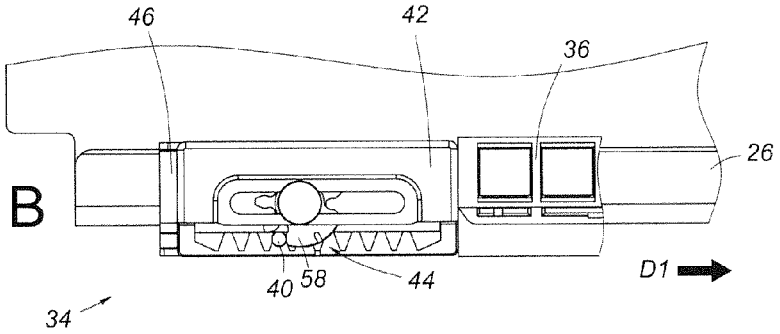
FIG. 11B schematically shows how the actuator in the embodiment of FIG. 11A drives the action member, and hence the pushing member, as the second rail is displaced relative to the first rail from a retracted position toward an extended position, and how in consequence the pushing member is displaced relative to the base from the predetermined position and thereby displaces the running carriage.
Figure 11C:
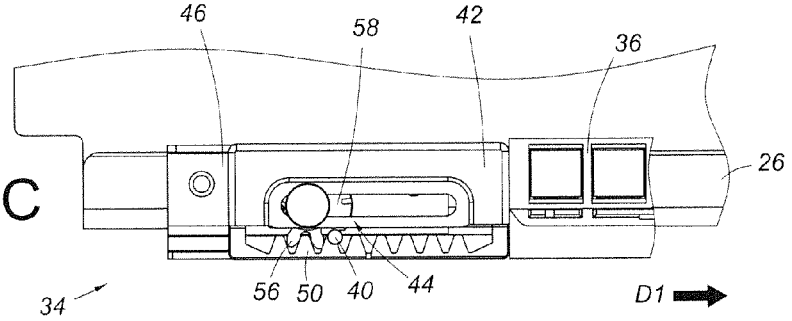
FIG. 11C schematically shows how the actuator in the embodiment of FIG. 11A further drives the action member, and hence the pushing member, as the second rail is displaced relative to the first rail from the retracted position toward the extended position, and how in consequence the pushing member is further displaced relative to the base from the predetermined position and thereby displaces the running carriage to an ideal position where the running carriage can be differentially moved relative to the second rail in a normal manner.
Figure 11D:
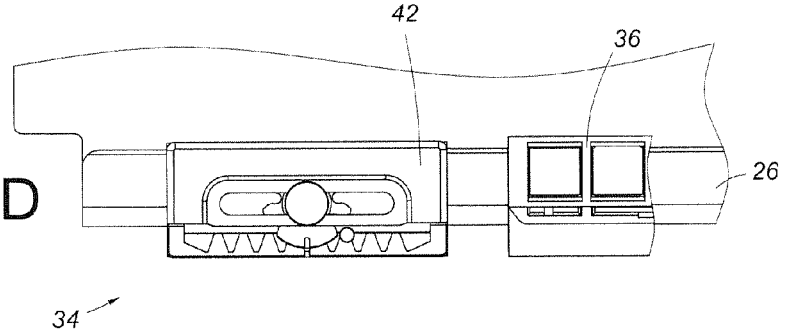
FIG. 11D schematically shows how the pushing member in the embodiment of FIG. 11A automatically returns to the predetermined position as a result of the actuator moving past the action member while the second rail is displaced relative to the first rail from the retracted position toward the extended position.

Referring now to FIG. 7C in conjunction with FIG. 7A, another force is applied to the pushing member 42 to displace the pushing member 42 in a second direction D2 from the predetermined position shown in FIG. 7A. In the course in which the pushing member 42 is displaced relative to the base 46 in the second direction D2, the second elastic section 64 of the elastic member 60 is compressed between the pushing member 42 and the dividing portion 48 and stores an elastic force. When the force applied is removed, the second elastic section 64 of the elastic member 60 releases the elastic force, in response to which the pushing member 42 automatically returns from the displaced position shown in FIG. 7C to the predetermined position shown in FIG. 7A.

FIG. 8A to FIG. 8D show a normal state in which, when the second rail 30 is longitudinally displaced relative to the first rail 26 in the first direction D1 from a retracted position toward an extended position (please note that, in FIG. 8A through FIG. 8D, the second rail 30 in displacement relative to the first rail 26 is represented by the actuator 40), the running carriage 36 is moved together with the second rail (the actuator 40) in the intended differential manner with respect to the second rail (the actuator 40). That is to say, when the second rail (the actuator 40) is displaced by a certain distance in the first direction D1, the running carriage 36 is synchronously and precisely moved by a distance which is a specific proportion (e.g., one half) of the distance by which the second rail (the actuator 40) is displaced. In this normal state, therefore, the correction mechanism 34 does not have to correct the differential movement of the running carriage 36. More particularly, while the second rail 30 (the actuator 40) is displaced in the first direction D1 from the retracted position toward the extended position, the actuator 40 pushes the contact portion 58 of the action member 44 and thereby drives the action member 44 into counterclockwise rotation. In turn, the teeth 56 of the action member 44 drive the toothed rack 50 of the pushing member 42, and the pushing member 42 is moved as a result (i.e., the pushing member 42 being movably connected to the action member 44). To be more specific, the pushing member 42 is displaced relative to the base 46 in the first direction D1 (see FIG. 8B and FIG. 8C). Once the actuator 40 is moved past the contact portion 58 of the action member 44, the pushing member 42 is subjected to the elastic force released by the first elastic section 62 of the elastic member 60 and hence automatically returns to the predetermined position (see FIG. 8D).

FIG. 9A to FIG. 9D show a normal state in which, when the second rail 30 is longitudinally displaced relative to the first rail 26 in the second direction D2 from the extended position toward the retracted position (please note that, in FIG. 9A through FIG. 9D, the second rail 30 in displacement relative to the first rail 26 is represented by the actuator 40), the actuator 40 pushes the contact portion 58 of the action member 44 and thereby drives the action member 44 into clockwise rotation. In turn, the teeth 56 of the action member 44 drive the toothed rack 50 of the pushing member 42, and the pushing member 42 is displaced relative to the base 46 and the first rail 26 in the second direction D2 (see FIG. 9B and FIG. 9C). Once the actuator 40 is moved past the contact portion 58 of the action member 44, the pushing member 42 is subjected to the elastic force released by the second elastic section 64 of the elastic member 60 and hence automatically returns to the predetermined position (see FIG. 9D).

However, after the second rail (the actuator 40) is repeatedly displaced back and forth relative to the first rail 26 in the first direction D1 and the second direction D2, it is no longer guaranteed that the distance by which the running carriage 36 is differentially moved will be precisely the preset proportion of the distance by which the second rail (the actuator 40) is displaced, the reason being the difference in rolling/sliding speed between the roller and the rails or some external factors. As a result, an abnormal condition arises when the running carriage 36 is differentially moved relative to the second rail (the actuator 40).

Referring to FIG. 10A to FIG. 10D, when an abnormal condition takes place, there is an error in differential movement of the running carriage 36 relative to the second rail (the actuator 40) and consequently in the position of the running carriage 36 during such differential movement. In other words, the running carriage 36 can no longer be differentially moved relative to the second rail (the actuator 40) according to the preset proportion. Therefore, while the second rail (the actuator 40) is retracted in the second direction D2 relative to the first rail 26 from the extended position, both the distance by which the running carriage 36 is displaced relative to the second rail (the actuator 40) and the position of the running carriage 36 are incorrect (or unideal).

To correct the abnormal condition, referring to FIG. 11A to FIG. 11D, the second rail (the actuator 40) is displaced relative to the first rail 26 in the first direction D1 from the retracted position toward the extended position such that the actuator 40 pushes the contact portion 58 of the action member 44 and thereby drives the action member 44 into counterclockwise rotation. In turn, the teeth 56 of the action member 44 drive the toothed rack 50 of the pushing member 42, and the pushing member 42 is displaced relative to the base 46 and the first rail 26 from the predetermined position (see FIG. 11A) in the first direction D1 (see FIG. 11B and FIG. 11C). Now that the displacement and position of the running carriage 36 relative to the second rail (the actuator 40) are incorrect (or unideal), the pushing member 42 is able to contact the running carriage 36 when displaced, thereby displacing the running carriage 36 to an ideal position where the running carriage 36 can be differentially moved relative to the second rail (the actuator 40) in a normal manner (see FIG. 11C). And in doing so, the correction mechanism 34 corrects the differential movement and position of the running carriage 36. Once the error in differential movement of the running carriage 36 relative to the second rail (the actuator 40) is corrected, the running carriage 36 can be differentially moved relative to the second rail (the actuator 40) in a normal manner again. As to the pushing member 42, it is subjected to the elastic force released by the first elastic section 62 of the elastic member 60 after the actuator 40 is moved past the contact portion 58 of the action member 44, and the elastic force automatically brings the pushing member 42 back to the predetermined position (see FIG. 11D).

Figure 12:
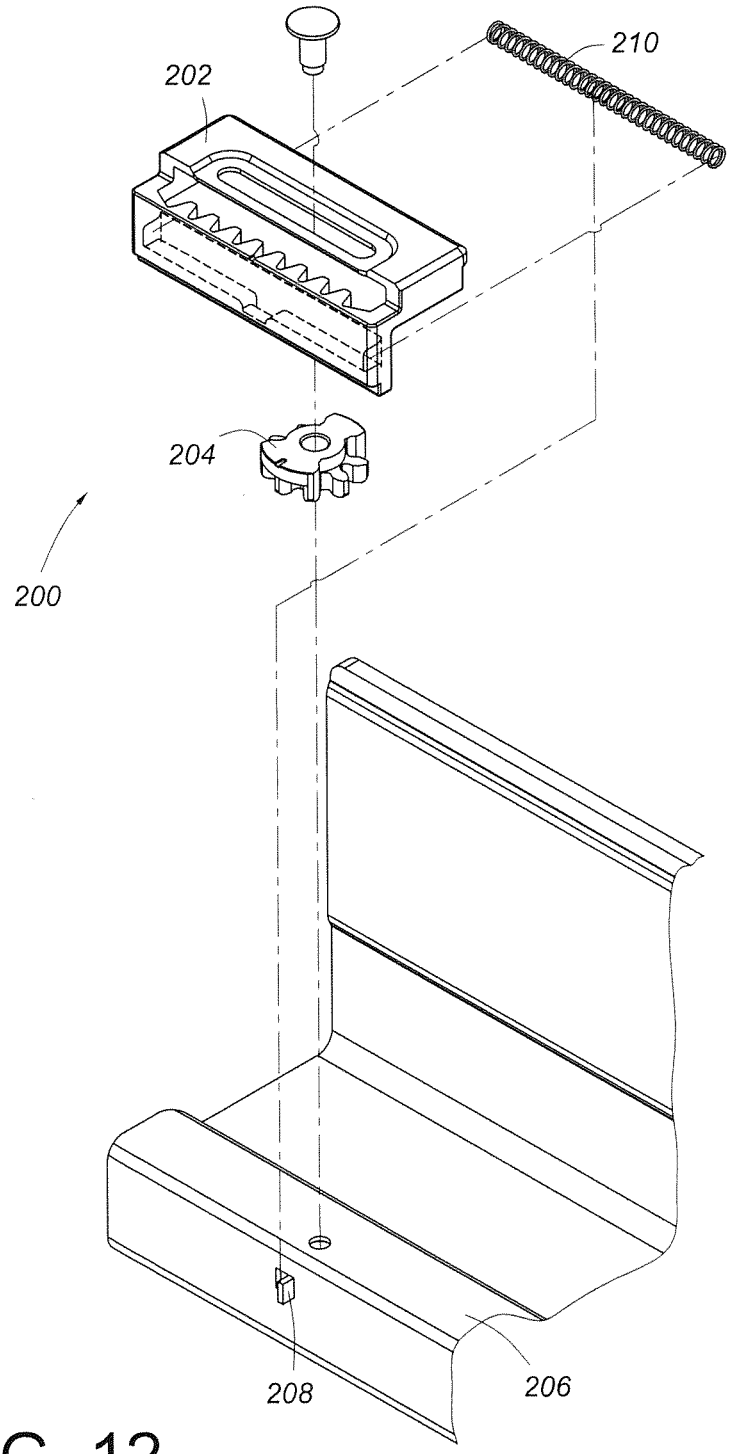
FIG. 12 is an exploded view of the correction mechanism in another embodiment of the present invention.

FIG. 12 shows the correction mechanism 200 in another embodiment of the present invention. The correction mechanism 200 is different from its counterpart in the previous embodiment substantially in that the pushing member 202 and the action member 204 of the correction mechanism 200 are directly mounted to the first rail 206 (i.e., the correction mechanism 200 dispenses with the base 46 in the previous embodiment), and that the first rail 206 includes the dividing portion 208 abutting against a portion of the elastic member 210. This structural arrangement is equally capable of achieving the technical effects stated above, and for the sake of simplicity, further description of the principle and operation of the correction mechanism 200 is omitted.

While the present invention has been disclosed by way of the foregoing preferred embodiments, the embodiments are not intended to be restrictive of the scope of the present invention. The scope of patent protection sought by the applicant is defined by the appended claims.

The invention claimed is:

1. A slide rail assembly, comprising:

a first rail;

a second rail longitudinally displaceable relative to the first rail;

a running carriage slidably mounted to the first rail for carrying the second rail;

a correction mechanism mounted to the first rail, the correction mechanism including an action member and a pushing member movably connected to the action member, wherein the action member is able to be driven by the second rail to displace the pushing member for displacing the running carriage to a position; and a pivotal connecting element for pivotally connecting the action member of the correction mechanism to the first rail, wherein the action member further includes a contact portion, and while the second rail is displaced relative to the first rail, a portion of the second rail pushes the contact portion and thereby drives the action member into rotation;

wherein the action member of the correction mechanism further includes teeth, and the pushing member further includes a toothed rack meshing with the teeth such that, when the action member is driven by the second rail, the teeth drive the toothed rack and thereby displace the pushing member relative to the first rail; and wherein the correction mechanism further includes an elastic member, and the pushing member is configured to automatically return from a displaced position to a predetermined position in response to an elastic force provided by the elastic member.

2. The slide rail assembly of claim 1, wherein the pushing member further includes a guide groove, and the pivotal connecting element extends through the guide groove.

3. A slide rail assembly, comprising:

a first rail;

a second rail longitudinally displaceable relative to the first rail between a retracted position and an extended position;

a running carriage slidably mounted to the first rail, carrying the second rail, and movable together with the second rail in a differential manner with respect to the second rail;

a correction mechanism mounted to the first rail, the correction mechanism including an action member and a pushing member movably connected to the action member;

an actuator connected to the second rail; and a pivotal connecting element for pivotally connecting the action member of the correction mechanism to the first rail, wherein the action member further includes a contact portion, and while the second rail is displaced relative to the first rail between the retracted position and the extended position, the actuator pushes the contact portion and thereby drives the action member into rotation;

wherein the action member of the correction mechanism further includes teeth, and the pushing member further includes a toothed rack meshing with the teeth such that, when the action member is driven by the actuator, the teeth drive the toothed rack and thereby displace the pushing member relative to the first rail;

wherein the correction mechanism further includes an elastic member, and the pushing member is configured to automatically return from a displaced position to a predetermined position in response to an elastic force provided by the elastic member; and wherein responsive to occurrence of an error in differential movement of the running carriage relative to the second rail, the actuator drives the action member while the second rail is displaced from the retracted position toward the extended position, in order for the action member to displace the pushing member relative to the first rail so that the pushing member is able to contact the running carriage and thereby displace the running carriage to correct the error.

4. The slide rail assembly of claim 1, wherein the pushing member further includes a guide groove, and the pivotal connecting element extends through the guide groove.

5. The slide rail assembly of claim 1, wherein the correction mechanism further includes a base connected to the first rail, and the pushing member is movably connected to the base.

6. The slide rail assembly of claim 5, wherein the base further includes a dividing portion, the pushing member further includes a receiving room for receiving the elastic member, and the dividing portion of the base abuts against a portion of the elastic member.

7. The slide rail assembly of claim 1, wherein the first rail further includes a dividing portion, the pushing member further includes a receiving room for receiving the elastic member, and the dividing portion of the first rail abuts against a portion of the elastic member.

8. The slide rail assembly of claim 1, wherein the running carriage further includes at least one roller for carrying the second rail.

9. A slide rail assembly applicable to a cabinet having a drawer, the slide rail assembly comprising:

a first rail mounted to the cabinet;

a second rail and a third rail, wherein the second rail is movably mounted between the first rail and the third rail and is longitudinally displaceable relative to the first rail between a retracted position and an extended position, and the third rail carries the drawer;

a running carriage slidably mounted to the first rail, carrying the second rail, and movable together with the second rail in a differential manner with respect to the second rail;

a correction mechanism mounted to the first rail, the correction mechanism including an action member and a pushing member movably connected to the action member;

an actuator connected to the second rail; and a pivotal connecting element for pivotally connecting the action member of the correction mechanism to the first rail, wherein the action member further includes a contact portion, and while the second rail is displaced relative to the first rail between the retracted position and the extended position, the actuator pushes the contact portion and thereby drives the action member into rotation;

wherein the action member of the correction mechanism further includes teeth, and the pushing member further includes a toothed rack meshing with the teeth such that, when the action member is driven by the actuator, the teeth drive the toothed rack and thereby displace the pushing member relative to the first rail;

wherein the correction mechanism further includes an elastic member, and the pushing member is configured to automatically return from a displaced position to a predetermined position in response to an elastic force provided by the elastic member; and wherein responsive to occurrence of an error in differential movement of the running carriage relative to the second rail, the actuator drives the action member while the second rail is displaced from the retracted position toward the extended position, in order for the action member to displace the pushing member relative to the first rail so that the pushing member is able to contact the running carriage and thereby displace the running carriage to correct the error.

10. The slide rail assembly of claim 9, wherein the correction mechanism further includes a base connected to the first rail, the pushing member is movably connected to the base, the base includes a dividing portion, the pushing member includes a receiving room for receiving the elastic member, and the dividing portion of the base abuts against a portion of the elastic member.

11. The slide rail assembly of claim 9, wherein the first rail further includes a dividing portion, the pushing member further includes a receiving room for receiving the elastic member, and the dividing portion of the first rail abuts against a portion of the elastic member.

* * * * *